US005603503A

United States Patent [19]

Lapidus

[11] Patent Number: 5,603,503

[45] Date of Patent: Feb. 18, 1997

[54] DYNAMIC TARGET AND GAME ASSEMBLY

[76] Inventor: Paul Lapidus, 9882 Cow Creek Dr., Palo Cedro, Calif. 96073

[21] Appl. No.: 195,620

[22] Filed: Feb. 9, 1994

[51] Int. Cl.[6] ..... F41J 3/02

[52] U.S. Cl. ..... 273/348.2; 273/403; 473/572

[58] Field of Search ..... 273/368, 161, 273/344, 348, 404, 403; 35/44

[56] References Cited

U.S. PATENT DOCUMENTS

| | | | |
|---|---|---|---|
| D. 122,424 | 9/1940 | Singer | 273/344 |
| 1,076,002 | 10/1913 | Clarke | 273/368 |
| 2,056,095 | 9/1936 | Cookson | 273/368 |
| 2,179,471 | 11/1939 | Lee | 273/368 |
| 2,231,640 | 2/1941 | Rubin | 273/344 |
| 3,014,724 | 12/1961 | Cryder et al. | 273/344 |
| 3,836,148 | 9/1974 | Manning | 273/368 |
| 4,193,213 | 3/1980 | Suda | 273/161 |

FOREIGN PATENT DOCUMENTS

| | | | |
|---|---|---|---|
| 30204 | 7/1964 | German Dem. Rep. | 273/344 |

*Primary Examiner*—Mark S. Graham
*Attorney, Agent, or Firm*—Thomas A. Turner, Jr.

[57] ABSTRACT

A transparent disk rotates in relation to a fixed surface having indicia on it in response to weighted darts adhered to a surface on the disk. The indicia on the fixed surface is observable through the transparent disk. A method of resolving the position of the rotatable disk in relation to the fixed disk includes adhering in tie sequence a plurality of such weighted darts, each causing the disk to rotate in turn about its center of rotation and to change the position of previously adhered darts in relation to the indicia on the fixed surface. Where the indicia comprises a pattern of marked areas each having scoring associated with it, a scoring for the corresponding darts can be calculated in accordance with the position of each dart in relation to the indicia as seen through the transparent disk surface.

4 Claims, 2 Drawing Sheets

Fig. 3
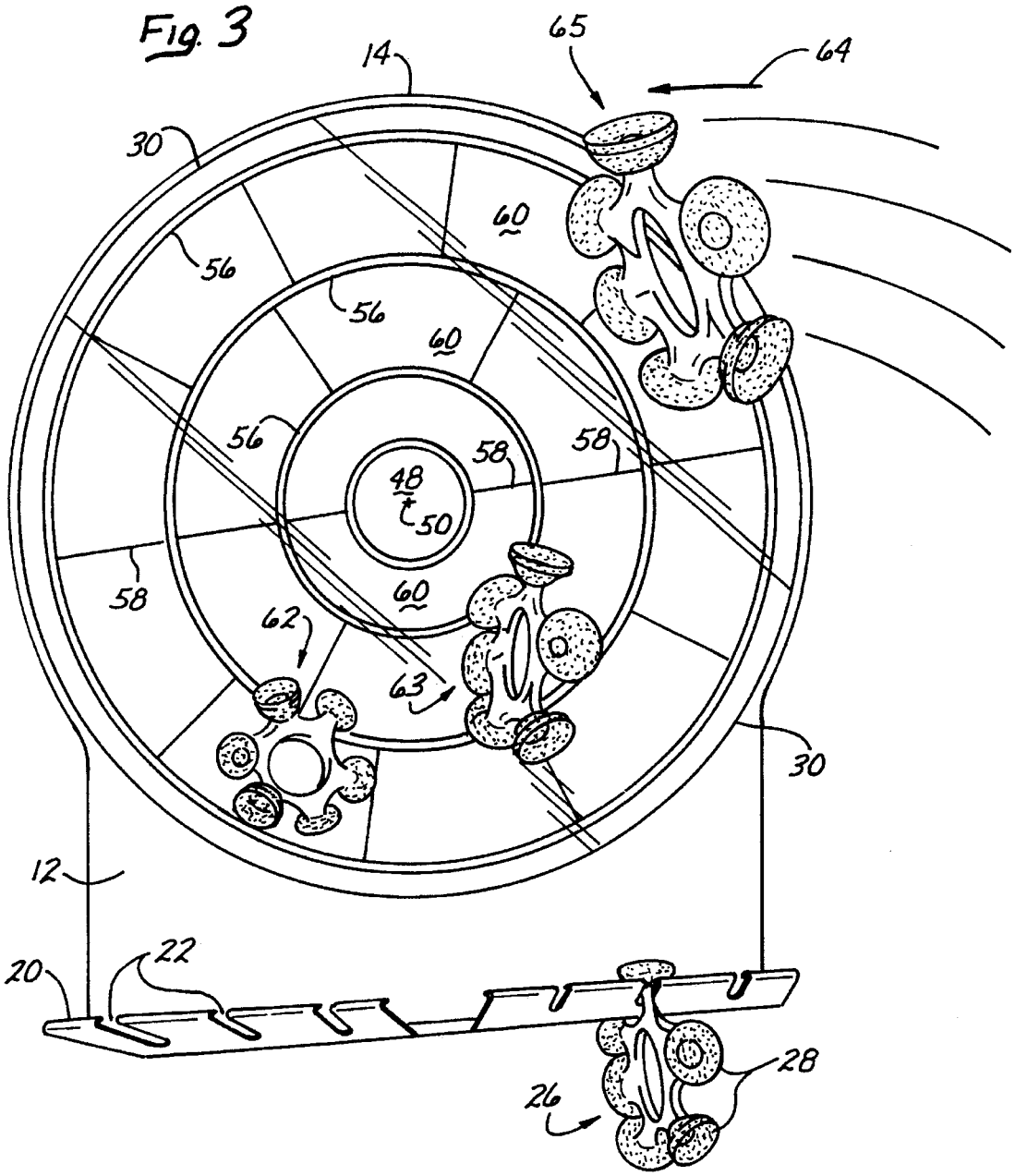
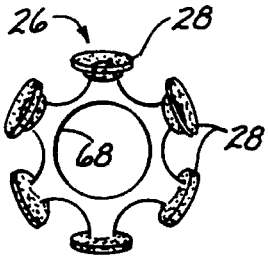
Fig. 4
Fig. 5
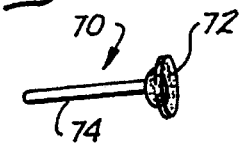
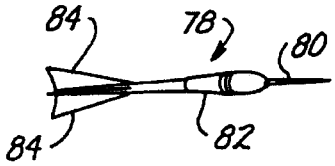
Fig. 6

DYNAMIC TARGET AND GAME ASSEMBLY

BACKGROUND OF THE INVENTION

1. Field of the Invention

The present invention relates to the art of toys and game of skill and chance, and more particularly relates to the art of darts and darts-like games played by a plurality of players.

2. Description of the Prior Art

In the past, the game of darts has been played where a dart board having indicia on its front surface is made from material which will receive and hold darts thrown into it. Typically, the indicia is a set of boundaries that define a plurality of areas each of which has assigned to it predetermined points, usually clearly marked. A plurality of darts are thrown by darters in series or, perhaps, alternately in turns. A darter's score is tabulated in accordance with the predetermined points for the areas in which his corresponding darts have adhered to the dart board. Hereinafter in this specification, references occasionally made to persons in the masculine gender are meant to include both the masculine and the feminine genders and, in all events, anything, whether animate or inanimate, which is capable of adhering objects under force to a board, as will be hereinafter described in greater detail.

Conventionally, once a dart has been adhered to the dart board, its position within the boundaries defined by the board's indicia is fixed for the duration of the game, or match. Darts may be of the traditional construction, having a sharp, pointed nose with a shaft having fins at its stern end, for stabilizing flight when it is launched or thrown, and for inserting into the dart broad with its pointed end with sufficient firmness to stay in the dart board until the dart is physically withdrawn by the darter. Alternatively, darts may be of the type having small suction cups at the lead end, so that when the darts is applied to the dart board under force, the suction cup will hold its dart to the surface of the dart board until the darter removes the dart from the board.

In more recent years, the traditional dart has been substituted by all manner of objects which are designed to adhere to a board. For example, a sphere or any shaped object having part or all of its surface area formed with a Velcro substance, with a receiving board surface having the complemental adhering surface of Velcro material has been used. Magnets thrown to a board having complemental magnetic field for accepting and adhering the magnets have also been used.

It has also been known to have dart board whose surface is rotated or is in a state of moving, so as to present a greater challenge to the darter to adhere his dart to a desired areas marked on the board.

In all such dart game configurations, once the darter has thrown the dart onto the board, the position of the dart in relation to the board's surface is fixed for the duration of the game and until the darter removes the dart from the board or other adhering board's surface. It is desired to provide a dart or dart like game and apparatus in which the target is dynamic and in which the position of the darts previously thrown are subject to relocation in relation to the indicia on the board's surface, in response to the play of other darters in the game.

SUMMARY

In brief, in accordance with one aspect of the present invention, a board is positioned having a surface with indicia printed on it. The board is fixed against a vertical wall, and the indicia define well marked areas having predetermined values for scoring purposes. Through the center of the board and substantially perpendicular to it, an axle is positioned. A circular disk having a center is mounted on the axle at the center to rotate about the axle. The disk is constructed to receive and to hold darts or like objects thrown with force onto the front surface of the disk.

The disk is substantially transparent, so the indicia on the surface of the board can be seen through the disk to persons throwing darts onto the disk's surface. As each darter throws a dart onto the disk, the dart, with its weight, creates a moment about the disk's center of rotation to rotate the disk. In so rotating the disk, all previously thrown objects adhering to the disk are accordingly rotated in relation to the indicia of the board surface seen through the transparent disk. In this manner, the throw of a dart or like object affects not only the position of the dart so thrown, but also all darts or like objects previously thrown and adhering to the disk. Not only is the board dynamic, but also the play of the darters dynamically affects the play of the other darters in the game.

Other novel features which are believed to be characteristic of the invention, both as to organization and methods of operation, together with further objects and advantages thereof, will be better understood from the following description in which preferred embodiments of the invention are described by way of example.

BRIEF DESCRIPTION OF THE DRAWINGS

FIG. 3 is a perspective view of the preferred embodiment of the present invention of FIGS. 1 and 2 showing a target assembly and darts in the process of play;

FIG. 4 is perspective view of a dart used in the play of the preferred embodiment of the present invention as shown in FIGS. 1–3;

FIG. 5 is a perspective view of an alternative embodiment showing an alternative dart for use in the preferred embodiment of the present invention; and, FIG. 6 is a perspective view of an alternative embodiment showing an alternative dart for use in the preferred embodiment of the present invention.

DESCRIPTION OF THE PREFERRED EMBODIMENT

Figure 1:
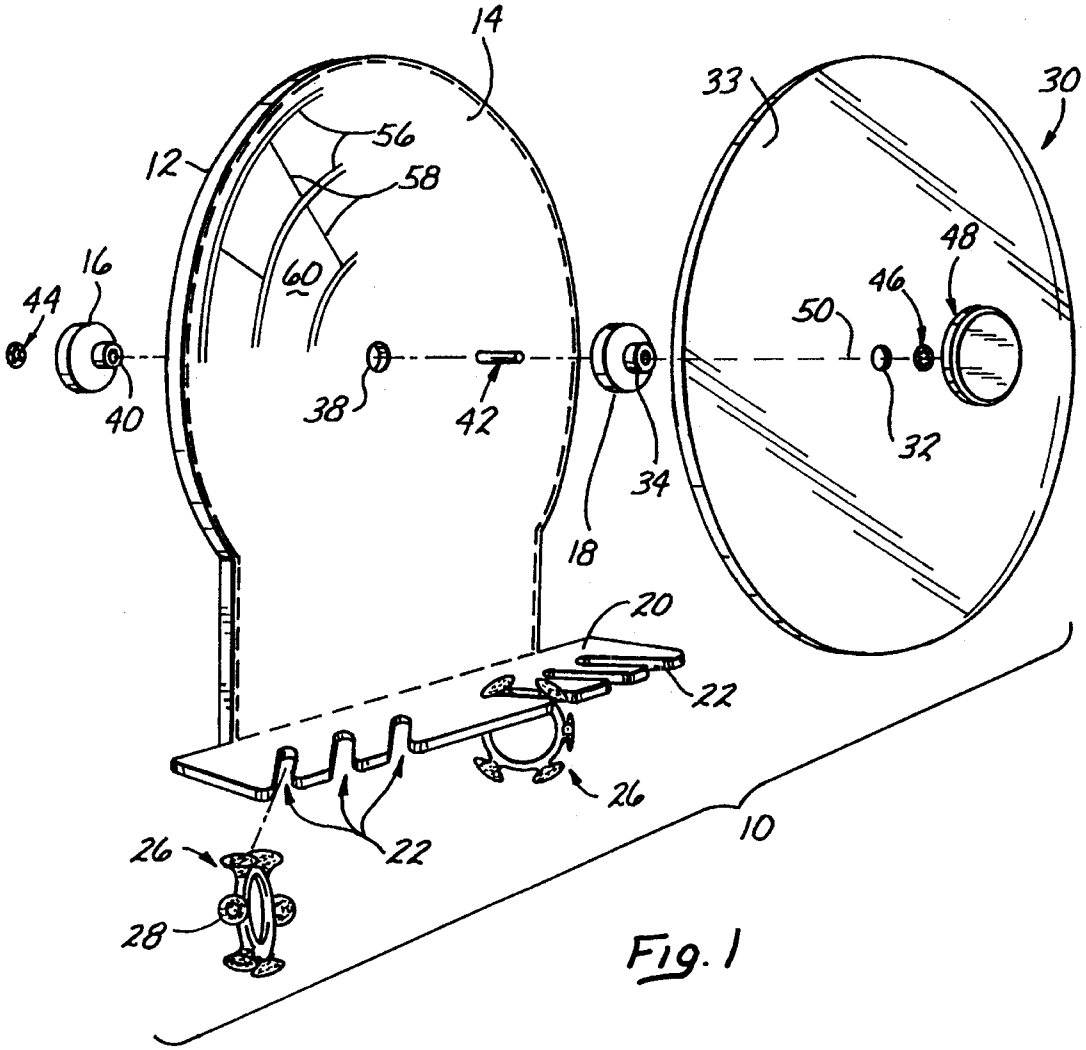
FIG. 1 is an exploded, perspective view of the preferred embodiment showing parts of the target assembly exploded for clarity in description.

In the preferred embodiment of the present invention, reference being had initially to FIG. 1 of the accompanying drawings, a target assembly 10 has a target board 12 with a front surface or face 14 capable of having indicia formed or imprinted thereon. The assembly 10 includes a rear hub 16 and a front hub 18 for holding the assembly 10 together, as will explained in greater detail below.

The target board 12 has a front ledge or shelf 20 formed at a right angle to the front surface 14. The shelf 20 has slots 22 receding from the foremost edge, the slots being shaped to receive and hold darts 26. The darts 26 shown in FIG. 1 have suction cups 28 can hold each individual dart 26 to a surface. The neck of each dart 26 can be inserted into the slots 22 whereby the dart 26 can be held onto the assembly 10.

The assembly includes a circular disk 30 having a central opening 32. The center opening 32 receives the grommet 34 of the front hub 18. The circular disk 30 is made of a material that is transparent, or at least sufficiently transparent so that lines and indicia behind it on the surface 14 of the target board 12 can be reasonably discerned.

Figure 2:
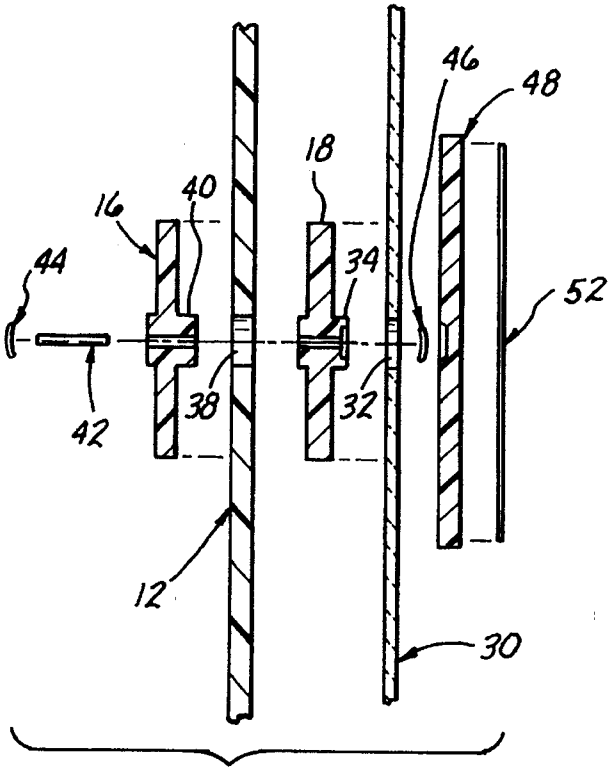
FIG. 2 is a side elevation view in cross-section showing parts of the target assembly of the preferred embodiment exploded for clarity in description.

The target board 12 is also formed with an opening 38, which receives the grommet 40 of the rear hub 16. The assembly 10 can be assembled, reference also being had to FIG. 2 of the accompanying drawings, which is a partial side elevation, cross-section of the hub area of the target assembly 10. An axle 42 is inserted along the centerline 50 through the eyes of the grommets 34, 40 when the corresponding grommets 34, 40 are inserted through their corresponding openings 32, 38. A rear retainer clip is positioned onto the rear end of the axle 42, and a front retainer clip 46 is positioned onto the front end of the axle 42. A hubcap 48 may be attached to the front end of the axle 42 to complete an assembly, if desired.

When the target assembly 10 is fully assembled, the circular disk 30 and hub 18 rotate about the axle 42. The front surface 33 of the disk 30 is presented to view and oncoming darts, as will be explained below. The disk 30 is reasonably transparent, so that one viewing the front surface 33 sees all markings of the surface 14 on the target board 12 behind the disk 30.

The assembled target 10 is shown, with reference to play in FIG. 3. The surface 14 has indicia or markings on it. These indicia include circular or concentrate rings 56 to divide the area into three concentrate rings about a central area defined by the hubcap 48. In addition, the surface 14 is marked by radial lines 58, to further mark boundaries on the surface. These markings 56, 58 define marked areas 60, to each of which can be assigned scores or points for measuring relative scores of players. The indicia scheme shown may be substituted with any number of possible alternative schemes, such as, for example, pie or wedge shaped areas or the like.

In FIG. 4 is shown, in perspective with substantial elevation, one of the darts 26 having the suction cups 28. The dart 26 is formed in a ring 68, having a total of six suction cups 28 positioned around it. All suction cups 28 face outwardly from the ring 68, so that when the dart 26 is hurled with force toward the disk surface 33, there is a high likelihood that one of the suction cups 28 will hit the front surface 33 with sufficient force to cause one of the suction cups 28 to adhere to the surface 33 of the disk 30.

A number of alternative dart forms may be used with effect in the operation and use of the preferred embodiment of the present invention. In FIG. 5, a dart 70 is shown in perspective view having a suction cup 72 and an elongated shaft 74 trailing behind. Such darts can be propelled with force against the disk 30 by hand or by spring loaded guns or the like. The effect of the dart upon the rotatable disk 30 will be similar to the effects caused by the darts 26 explained hereinabove. The scores ultimately reached will be a function of the final areas 60 visibly within which the suction cup 72 rests at the end of the game.

Another alternative dart form is shown in perspective in FIG. 6, in which the dart 78 has a needle point 80 held onto a shaft 82. The dart 78 has tail feathers or fins 84 for maintaining the flight form when the dart 78 is hurled with force against the disk 30. The disk 30, while being transparent, should be formed sufficiently thick enough to receive and hold the needle points 80 of the darts 78 when darts 78 of this form are to be used.

When the darts 78 are used, the effect on the rotation of the disk 30 will be similar to that caused by the use of the darts 26, as explained hereinabove.

In operation, the disk 30 is rotatably mounted about centerline 50 on axle 42 in relation to the target board 12 and its front surface 14 having indicia 56, 58, 60 imprinted or otherwise formed thereon. A first dart 62 is hurled with force onto the front surface 33 of the disk 30, and one of the suction cups 28 on the dart 62 engages the front surface 33 sufficiently to cause a suction adherence of the dart 62 to the disk 30. The disk 30 will likely rotate until the dart 62 rests at the 6:00 o'clock position, due to the weight of the dart 62. Next, another dart 63 is hurled with force toward the target assembly 10. One of the suction cups 28 of dart 63 engages the front surface 33 of the disk 30 with sufficient force to cause suction adherence of the dart 63 to the front surface 33 at a different location than the location where dart 62 adhered to the disk 30. The weight of additional dart 63 causes a different moment arm on disk 30, which accordingly rotates about axle 42, so that the disk 30 comes to rest at a different radial position, where the moment arms created by dart 63 balances the moment arm created by dart 62.

An additional dart 65 is hurled toward the front surface 33 of the disk 30 in the direction of arrow 64, as shown best in FIG. 3. When the (dart 65 adheres to the disk 30, a new moment arm of force will be created in accordance with the point or position on the surface 33 of disk 30 at which the dart 65 adheres. The disk 30 will rotate about the axle 42 so as to come to rest where the cumulative moment arms of force balance and are equalized.

Meanwhile, with each new adherence of a dart on the disk 30, the position of all darts 62, 63 adhered previously to the disk 30 are changed with respect to the fixed surface 14 of the target board 12, and are consequently changed with respect to the areas 60 and their corresponding area defining boundaries 56, 58. If each of the areas 60 are assigned different scoring values, it may be seen that each new throw of the darts which adhere to the disk 30, will change the scoring attributable to the previously thrown darts. In this manner, each successive player throwing a dart can effectively change the score of the previous throws of his opponent and of himself. Since the disk 30 is transparent, or at least sufficiently transparent to read the boundaries 56, 58 defining the areas 60, and the scores assigned to the areas 60 behind the disk 30, when the disk 30 finally comes to rest at the end of a game, the final score of the players can be tallied.

The foregoing description of my invention and of preferred embodiments as to products, compositions and processes is illustrative of specific embodiments only. It is to be understood, however, that additional embodiments may be perceived by those skilled in the art. The embodiments described herein, together with those additional embodiments, are considered to be within the scope of the present invention.

I claim:

1. A target assembly comprising in combination:

a. a target surface having indicia formed thereon and having a bearing therethrough for receiving an axle;

b. a generally circular, rotatable clear transparent disk comprising a front surface, a center of rotation with a bearing on said disk at said center of rotation, and further comprising means for receiving and holding objects thrown onto said disk front surface;

c. axle means connected to said target surface and rotatably connected to said disk at said bearing, for rotatably connecting said disk in relation to said target surface; and, d. a plurality of darts, each of which being capable of being held by said disk front surface when said each dart is caused to come into contact with said front surface of said disk.

2. The target assembly of claim 1 wherein each of said darts comprises a dart having suction means for holding said dart on said disk front surface onto which said darts come into contact under force.

3. The target assembly of claim 1 wherein each of said darts comprises a dart having needle means for holding said dart on said disk front surface onto which said darts come into contact under force.

4. The target assembly of claim 1 wherein said front disk surface is rotated about said axle and in relation to said target surface having indicia thereon, each time one of said darts is held on said front disk surface.

* * * * *